US012605597B1

(12) United States Patent
LeBlanc et al.

(10) Patent No.: US 12,605,597 B1
(45) Date of Patent: Apr. 21, 2026

(54) ADHESIVE STRESS REDUCTION FEATURE OF A BONDED JOINT IN A GOLF CLUB HEAD

(71) Applicant: Topgolf Callaway Brands Corp., Carlsbad, CA (US)

(72) Inventors: Dominic LeBlanc, Carlsbad, CA (US); Brandon DeMille, Carlsbad, CA (US)

(73) Assignee: Callaway Golf Company., Carlsbad, CA (US)

( * ) Notice: Subject to any disclaimer, the term of this patent is extended or adjusted under 35 U.S.C. 154(b) by 265 days.

(21) Appl. No.: 18/378,050

(22) Filed: Oct. 9, 2023

Related U.S. Application Data

(60) Provisional application No. 63/416,658, filed on Oct. 17, 2022.

(51) Int. Cl.
*A63B 53/04* (2015.01)

(52) U.S. Cl.
CPC ..... *A63B 53/0408* (2020.08); *A63B 53/0466* (2013.01); *A63B 53/0433* (2020.08); *A63B 53/0437* (2020.08); *A63B 2209/00* (2013.01)

(58) Field of Classification Search
CPC ..... A63B 53/0466; A63B 2209/00; A63B 53/042
See application file for complete search history.

(56) References Cited

U.S. PATENT DOCUMENTS 6,244,976 B1 6/2001 Murphy et al.
6,332,847 B2 12/2001 Murphy et al.
6,386,990 B1 5/2002 Reyes et al.
6,406,378 B1 6/2002 Murphy et al.
6,440,008 B2 8/2002 Murphy et al.
6,471,604 B2 10/2002 Hocknell et al.
6,478,692 B2 11/2002 Kosmatka
6,491,592 B2 12/2002 Cackett et al.
6,508,978 B1 1/2003 Deshmukh
6,527,650 B2 3/2003 Reyes et al.
6,565,452 B2 5/2003 Helmstetter et al.
6,575,845 B2 6/2003 Galloway et al.
6,582,323 B2 6/2003 Soracco et al.
6,592,466 B2 7/2003 Helmstetter et al.
6,602,149 B1 8/2003 Jacobson
6,607,452 B2 8/2003 Helmstetter et al.
6,612,398 B1 9/2003 Tokimatsu et al.
6,663,504 B2 12/2003 Hocknell et al.
6,669,578 B1 12/2003 Evans
6,676,536 B1 * 1/2004 Jacobson ..... A63B 53/04 473/345
6,739,982 B2 5/2004 Murphy et al.
6,758,763 B2 7/2004 Murphy et al.
6,860,824 B2 3/2005 Evans
6,994,637 B2 2/2006 Murphy et al.
7,025,692 B2 4/2006 Erickson et al.
7,070,517 B2 7/2006 Cackett et al.
7,112,148 B2 9/2006 Deshmukh
(Continued)

*Primary Examiner* — Raeann Gorden
(74) *Attorney, Agent, or Firm* — Michael A. Catania; Daniel Moderick

(57) ABSTRACT

A golf club head having a stress reducing feature at a composite joint is disclosed herein. The stress reducing feature is preferably cylindrical with a circular groove that has a radius R_Groove that ranges between 0.005 inch and 0.050 inch. An adhesive thickness along the front of a joint t_gap_front preferably ranges between 0.002 inch and 0.060 inch.

1 Claim, 16 Drawing Sheets

(56) References Cited

U.S. PATENT DOCUMENTS

| | | | | |
|---|---|---|---|---|
| 7,118,493 | B2 | 10/2006 | Galloway | |
| 7,121,957 | B2 | 10/2006 | Hocknell et al. | |
| 7,125,344 | B2 | 10/2006 | Hocknell et al. | |
| 7,128,661 | B2 | 10/2006 | Soracco et al. | |
| 7,163,470 | B2 | 1/2007 | Galloway et al. | |
| 7,226,366 | B2 | 6/2007 | Galloway | |
| 7,252,600 | B2 | 8/2007 | Murphy et al. | |
| 7,258,631 | B2 | 8/2007 | Galloway et al. | |
| 7,314,418 | B2 | 1/2008 | Galloway et al. | |
| 7,320,646 | B2 | 1/2008 | Galloway | |
| 7,387,577 | B2 | 6/2008 | Murphy et al. | |
| 7,396,296 | B2 | 7/2008 | Evans | |
| 7,402,112 | B2 | 7/2008 | Galloway | |
| 7,407,448 | B2 | 8/2008 | Stevens et al. | |
| 7,413,520 | B1 | 8/2008 | Hocknell et al. | |
| 7,431,667 | B2 | 10/2008 | Vincent et al. | |
| 7,438,647 | B1 | 10/2008 | Hocknell | |
| 7,455,598 | B2 | 11/2008 | Williams et al. | |
| 7,476,161 | B2 | 1/2009 | Williams et al. | |
| 7,491,134 | B2 | 2/2009 | Murphy et al. | |
| 7,497,787 | B2 | 3/2009 | Murphy et al. | |
| 7,530,903 | B2 * | 5/2009 | Imamoto | A63B 60/02 473/335 |
| 7,549,935 | B2 | 6/2009 | Foster et al. | |
| 7,578,751 | B2 | 8/2009 | Williams et al. | |
| 7,717,807 | B2 | 5/2010 | Evans et al. | |
| 7,749,096 | B2 | 7/2010 | Gibbs et al. | |
| 7,749,097 | B2 | 7/2010 | Foster et al. | |
| 8,834,294 | B1 | 9/2014 | Seluga et al. | |
| 8,956,244 | B1 | 2/2015 | Westrum et al. | |
| 9,067,110 | B1 | 6/2015 | Seluga et al. | |
| 9,180,349 | B1 | 11/2015 | Seluga et al. | |
| 9,259,627 | B1 | 2/2016 | Myers et al. | |
| 9,283,447 | B1 | 3/2016 | DeMille et al. | |
| 9,345,936 | B1 | 5/2016 | Westrum et al. | |
| 9,352,199 | B2 | 5/2016 | Seluga et al. | |
| 9,381,409 | B1 | 7/2016 | Griffin et al. | |
| 9,387,373 | B1 | 7/2016 | DeMille et al. | |
| 9,468,819 | B2 | 10/2016 | Rice et al. | |
| 9,757,629 | B2 | 9/2017 | Seluga et al. | |
| 9,776,058 | B2 | 10/2017 | Seluga et al. | |
| 9,968,834 | B1 | 5/2018 | Seluga et al. | |
| 10,099,096 | B2 | 10/2018 | Seluga | |
| 10,105,579 | B1 | 10/2018 | DeMille et al. | |
| 10,238,933 | B1 | 3/2019 | Seluga et al. | |
| 10,716,984 | B2 | 7/2020 | Frederickson | |
| 10,912,970 | B1 | 2/2021 | Hanhart et al. | |
| 11,027,176 | B2 | 6/2021 | Del Rosario et al. | |
| 11,083,939 | B1 | 8/2021 | Frederickson | |
| 11,090,534 | B2 | 8/2021 | Westrum et al. | |
| 11,331,544 | B1 | 5/2022 | DeMille et al. | |
| 11,364,423 | B2 | 6/2022 | Nunez et al. | |
| 11,400,349 | B2 | 8/2022 | Davis et al. | |
| 11,433,281 | B2 | 9/2022 | Seluga et al. | |
| 11,433,282 | B2 | 9/2022 | Gibbs et al. | |
| 2003/0125130 | A1 | 7/2003 | Galloway et al. | |
| 2004/0055696 | A1 | 3/2004 | Reyes et al. | |
| 2004/0058743 | A1 | 3/2004 | Hettinger et al. | |
| 2004/0058745 | A1 | 3/2004 | Clausen et al. | |
| 2004/0058747 | A1 | 3/2004 | Clausen et al. | |
| 2004/0106466 | A1 | 6/2004 | Wieland et al. | |
| 2004/0180732 | A1 | 9/2004 | Reyes et al. | |
| 2004/0229715 | A1 | 11/2004 | Dewanjee et al. | |
| 2005/0026724 | A1 | 2/2005 | Deshmukh | |
| 2005/0130765 | A1 | 6/2005 | Wieland et al. | |
| 2007/0004527 | A1 | 1/2007 | Helmstetter | |
| 2007/0293348 | A1 | 12/2007 | Hocknell et al. | |
| 2008/0280694 | A1 | 11/2008 | Hocknell et al. | |
| 2010/0120550 | A1 | 5/2010 | Galloway | |
| 2010/0210374 | A1 | 8/2010 | Galloway | |
| 2011/0077102 | A1 | 3/2011 | Cackett et al. | |
| 2019/0224538 | A1 * | 7/2019 | Spackman | A63B 53/0466 |
| 2021/0060392 | A1 * | 3/2021 | Greaney | A63B 53/0437 |
| 2022/0184471 | A1 * | 6/2022 | Greaney | A63B 53/02 |
| 2025/0144480 | A1 * | 5/2025 | Harbert | A63B 53/0433 |

* cited by examiner

90

| MODEL | Test Speed | Norm.Test Speed | Hits | Normalized Hits | Change |
|---|---|---|---|---|---|
| **Baseline Crown Joint** | 125 | 92.59259259 | 1800 | 1000 | No Change |
| **Baseline Crown Joint** | 125 | 92.59259259 | 1200 | 666.6666667 | ***Crown Separated*** |
| **Baseline Crown Joint** | 125 | 92.59259259 | 1800 | 1000 | No Change |
| **Baseline Crown Joint** | 125 | 92.59259259 | 1800 | 1000 | No Change |
| **Baseline Crown Joint** | 125 | 92.59259259 | 1800 | 1000 | No Change |
| **Baseline Crown Joint** | 125 | 92.59259259 | 1800 | 1000 | No Change |
| **Baseline Crown Joint** | 125 | 92.59259259 | 720 | 400 | ***Crown Separated*** |
| **Baseline Crown Joint** | 135 | 100 | 1800 | 1000 | No Change |
| **Baseline Crown Joint** | 135 | 100 | 197 | 109.4444444 | ***Crown Separated*** |
| **Baseline Crown Joint** | 135 | 100 | 752 | 417.7777778 | ***Crown Separated*** |
| **Baseline Crown Joint** | 135 | 100 | 716 | 397.7777778 | ***Crown Separated*** |
| **Modified Crown Joint** | 135 | 100 | 1800 | 1000 | No Change |
| **Modified Crown Joint** | 135 | 100 | 1800 | 1000 | No Change |
| **Modified Crown Joint** | 135 | 100 | 1800 | 1000 | No Change |
| **Modified Crown Joint** | 135 | 100 | 1800 | 1000 | No Change |
| **Modified Crown Joint** | 135 | 100 | 1800 | 1000 | No Change |

92

| MODEL | Test Speed | Normalized Test Speed | Avg | stdeV | 2stdeV | 3dteV |
|---|---|---|---|---|---|---|
| Baseline Crown Joint -93% TS | 125 | 92.59259259 | 867 | 240.370085 | 480.7401701 | 721.1103 |
| Baseline Crown Joint -100% TS | 135 | 100 | 481 | 373.4243647 | 746.8487295 | 1120.273 |
| Groove Modification-Crown Joint -100% TS | 135 | 100 | 1000 | 0.001 | 0.002 | 0.003 |
| Baseline Crown Joint -125 mph TS | 125 | 92.59259259 | 1560 | 432.6661531 | 865.3323061 | 1297.998 |
| Baseline Crown Joint -125mph TS | 135 | 100 | 866 | 672.1638565 | 1344.327713 | 2016.492 |
| Modified Crown Joint -135mph TS | 135 | 100 | 1800 | 0.001 | 0.002 | 0.003 |

FIG. 9

ADHESIVE STRESS REDUCTION FEATURE OF A BONDED JOINT IN A GOLF CLUB HEAD

CROSS REFERENCES TO RELATED APPLICATIONS

The Present Application claims priority to U.S. Provisional Patent Application No. 63/416,658, filed on Oct. 17, 2022, which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention relates to multi-material golf club heads.

Description of the Related Art

The center of gravity (CG) of a golf head is crucial to its performance. The CG of a golf head affects the spin and launch profile of the ball as it leaves the golf head. Because of this golf club manufacturers often combine metallic golf club head bodies with composite crowns to lower the club's center of gravity and thus improving the overall mass properties of the head (FIG. 1). To that same extend, lightweight composite materials can also be used in the sole of a driver design in order to increase the overall moment of inertia as well as target a specific CG depth or bias. For example, a sole plate located in the toe area of a driver design would move the center of gravity heel-ward thus promoting draw bias. Generally speaking a lap joint or step structure is employed as illustrated in FIG. 2. This prior art design, although straightforward to manufacture leads to challenges as it may lead to high stress areas at the front of the bond joint (FIG. 2*b*, FIG. 2*c*), which means a great deal of stress is placed on the adhesive when the club head impacts a golf ball.

In some cases where the stress in the bond joint are high, the adhesive may yield and cause the start of a crack and its propagation. Throughout repeated use of the golf club impacting golf balls, this type of failure may propagate to the point of the crown or sole to separate from the body deeming the golf head unusable.

BRIEF SUMMARY OF THE INVENTION

In order to overcome the limitation of this design the following may lead to improvements in durability: Increasing the bond length (FIG. 3) can help reduce the average adhesive stress in the adhesive. In the case that the high stress is at the front of the bond joint, this extension being away from the problematic issue may not be very effective in reducing the issue. Moving the overall bond flange away from the impact location will reduce the stress on the adhesive. In this case, the effectiveness of the composite crown or sole is reduced from a mass or performance standpoint. Addition of inner pads below the bond flange. This technique promotes the increase in stiffness near the bond flange then reduces the stress on the bond flange associated with bending loads.

The methods explained above, although successful in improving overall durability of a composite bonded joint has the disadvantage of reducing the overall effectiveness of composite panel as it relates to weight savings and performance.

One aspect of the present invention is a golf club head comprising a body comprising a face section, a composite sole section and a composite crown section. The body defining a hollow interior. The golf club head has a stress reducing feature at a composite bonded joint.

The stress reducing feature is preferably cylindrical with a circular groove that has a radius R_Groove that preferably ranges between 0.005 inch and 0.050 inch.

Alternatively, the stress reducing feature is an intersecting corner, and an intersection of the corner groove is blended (t_Corner_Groove_Blend_Radius) and has a radius that ranges between 0.005 inch and 0.060 inch.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 9 is a table.

DETAILED DESCRIPTION OF THE INVENTION

Figure 2A:
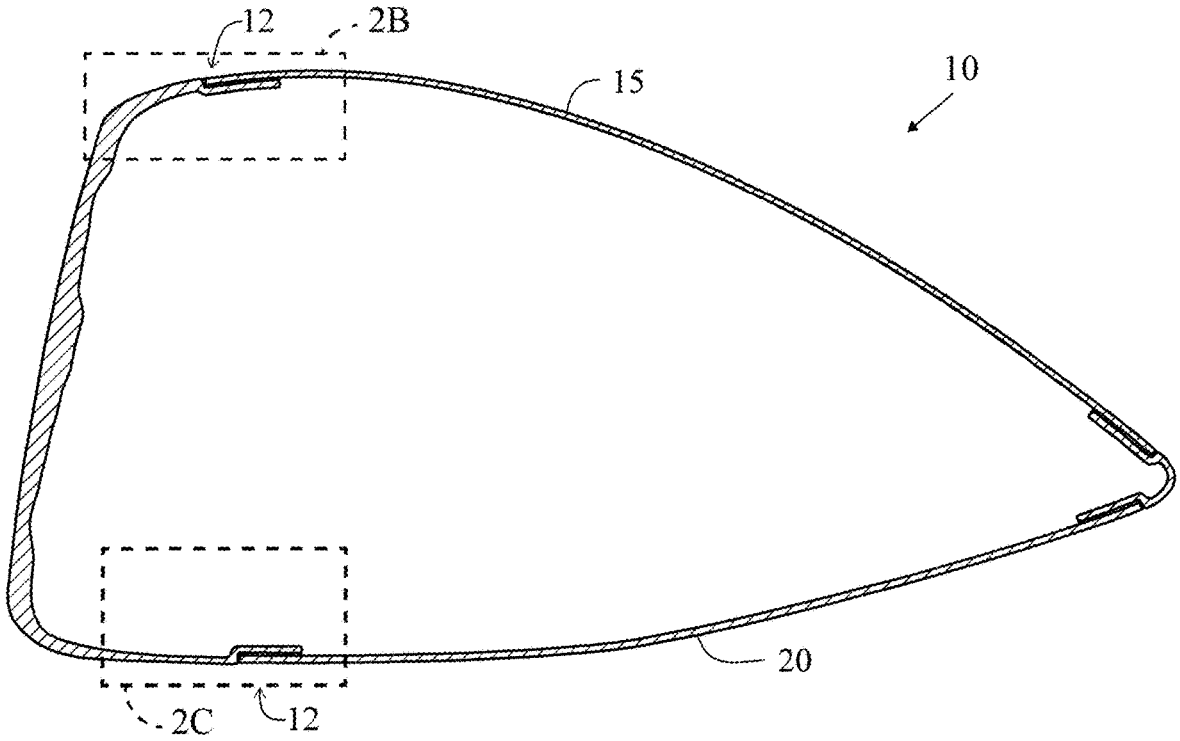
FIG. 2A is a cross-sectional view of a golf club head.
Figure 2B:
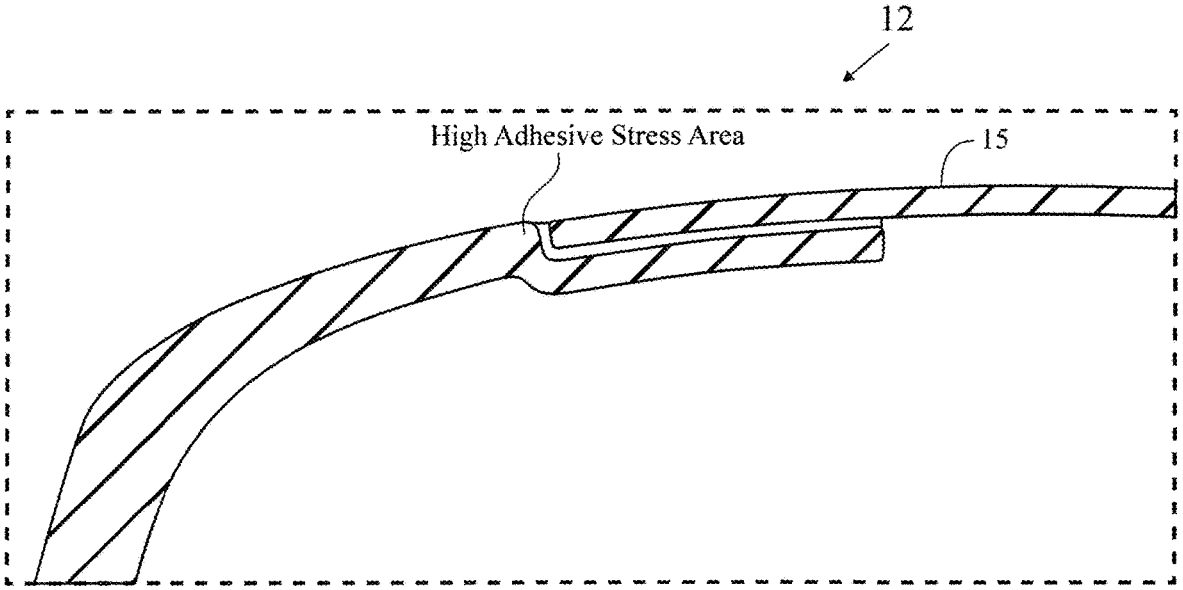
FIG. 2B is an isolated cross-sectional view of a crown-face bonding site.
Figure 2C:
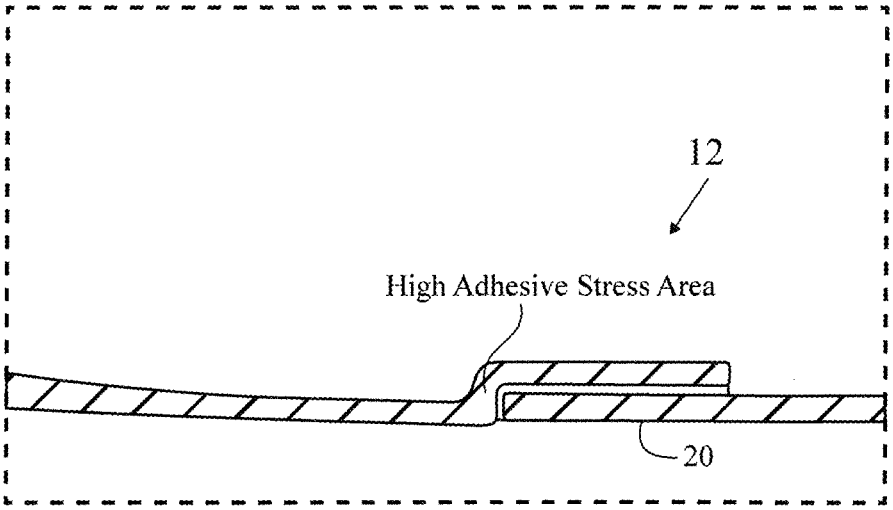
FIG. 2C is an isolated cross-sectional view of a sole-face bonding site.

The purpose of the present invention is to propose weight efficient methods to increase the overall durability of metal to composite bonded joints in a driver head. When performing structural analysis on driver heads with a butt joint composite crown/sole there is generally speaking a high adhesive stress region near the front of the joint 12, as shown in FIGS. 2A-2C. When this stress is above a certain level, it can lead to the failure of or the yielding of the adhesive thus resulting in the propagation of a crack, ultimately causing bonded joint failure.

Figure 3:
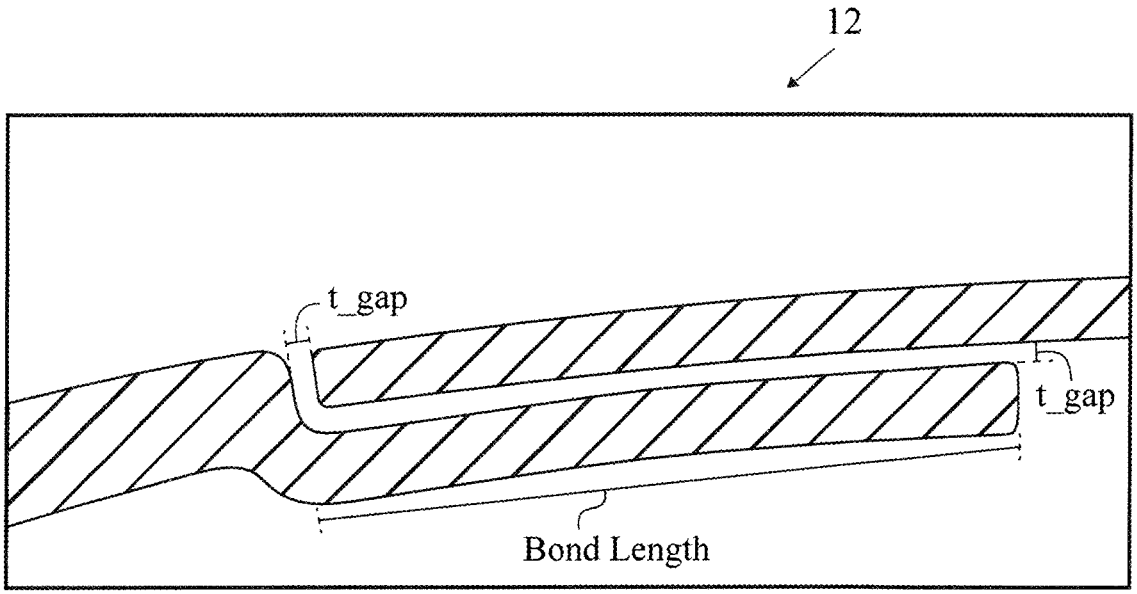
FIG. 3 is an isolated cross-sectional view of a crown-face bonding site.

FIG. 3 show the adhesive thickness t_gap of the joint 12 and the bond length of the high adhesive stress region.

The present invention pertains to a series of design features near the interface of a composite bonded joint 12 in a golf head 10. As described above, the typical high stress region of a bonded joint is generally near the front of the joint 12 (FIGS. 2B-2C).

Figure 4A:
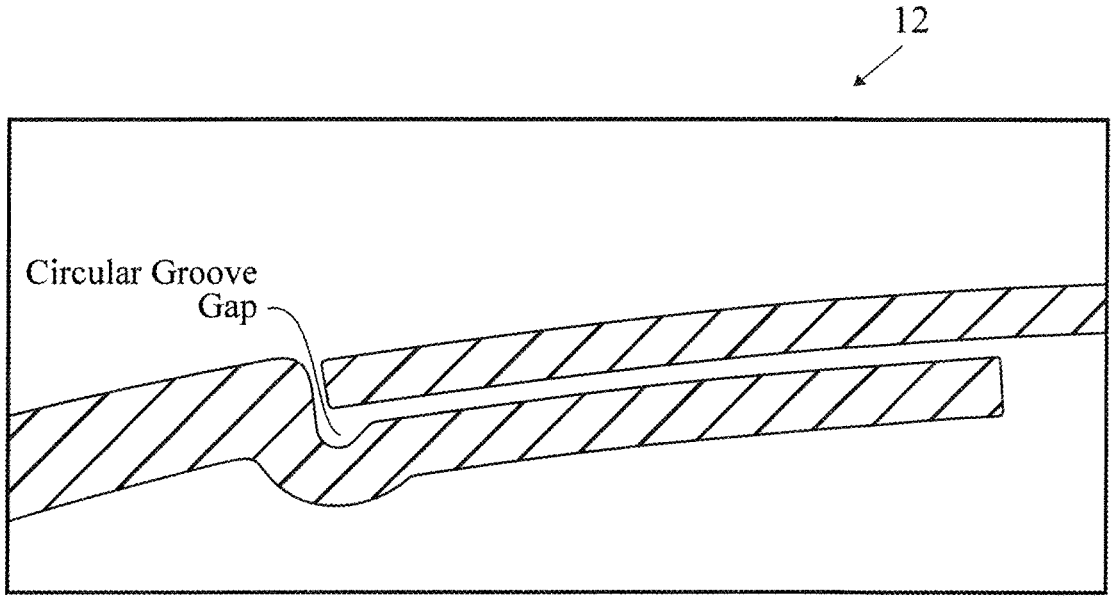
FIG. 4A is an isolated cross-sectional view of a crown-face bonding site.
Figure 4B:
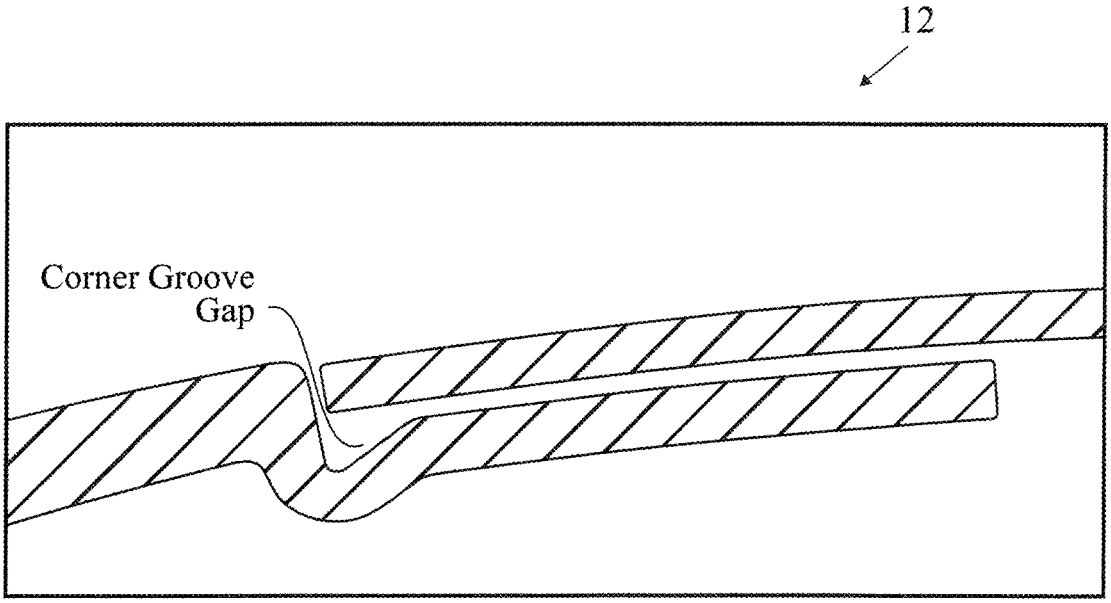
FIG. 4B is an isolated cross-sectional view of a crown-face bonding site.
Figure 4C:
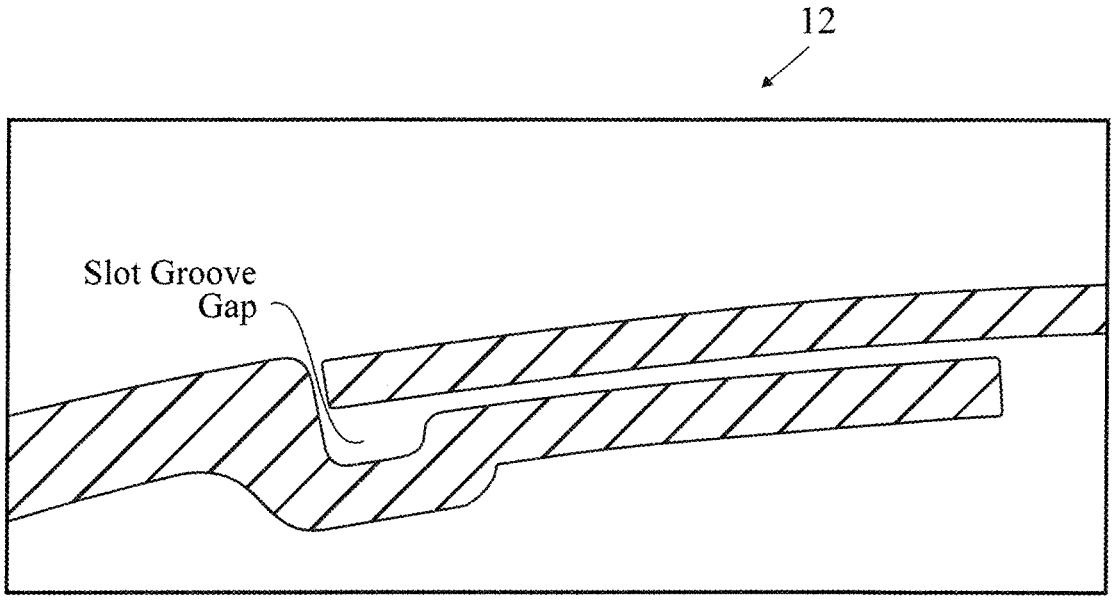
FIG. 4C is an isolated cross-sectional view of a crown-face bonding site.

In order to reduce the adhesive stress, but also prevent crack propagation and adhesive failure, a groove feature can be incorporated at the bond joint 12 interface, as illustrated in FIGS. 4A-4C.

For the purpose of this invention, the fiber reinforcement in the composite material system may include carbon, fiberglass, aramid or any combination of the three. The matrix material that is combined with the fiber bundles to create the composite material of the present invention can be a thermosetting (epoxy, polyester, vinyl ester, etc.) or a thermoplastic (nylon, polycarbonate, PPS, PEKK, PEEK, etc.) material. Lastly, fabric area weight (FAW) of each composite ply can range from 20 gsm up to 500 gsm.

The following components in a composite bonded joint 12 of a golf club head 10 with respect to the present invention is described with reference to FIGS. 1A-1C.

Figure 1A:
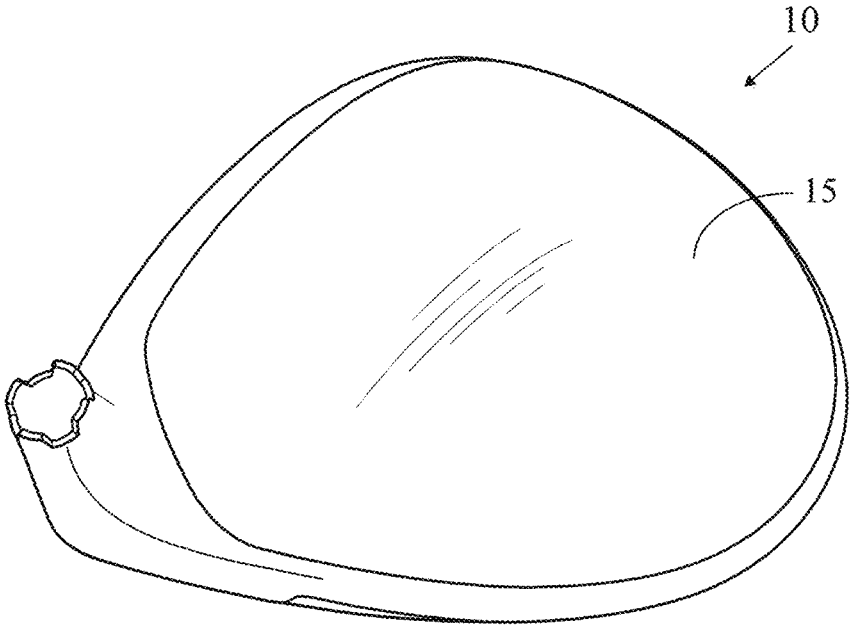
FIG. 1A is top perspective view of a golf club head.
Figure 1B:
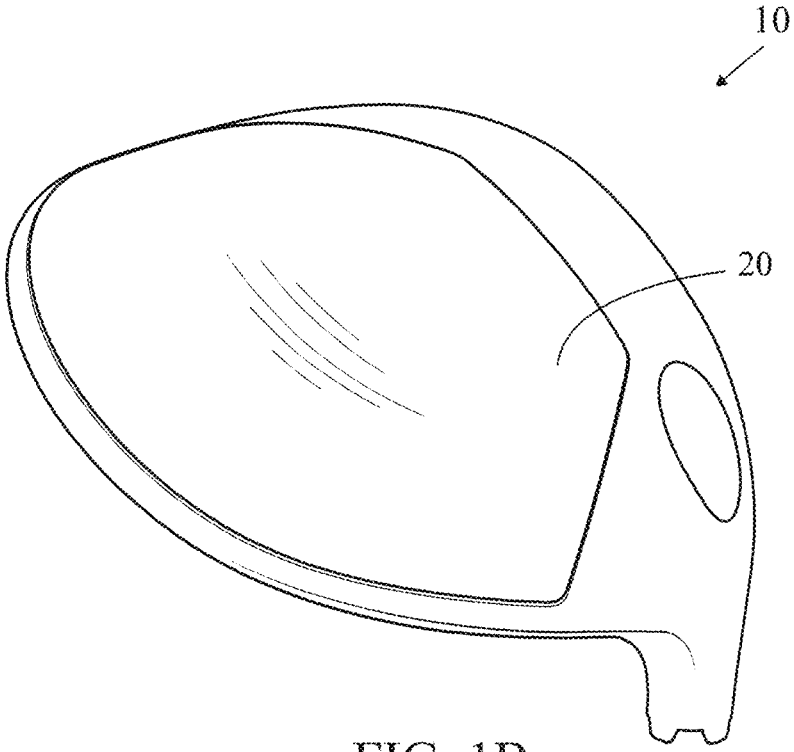
FIG. 1B is a bottom perspective view of a golf club head.
Figure 1C:
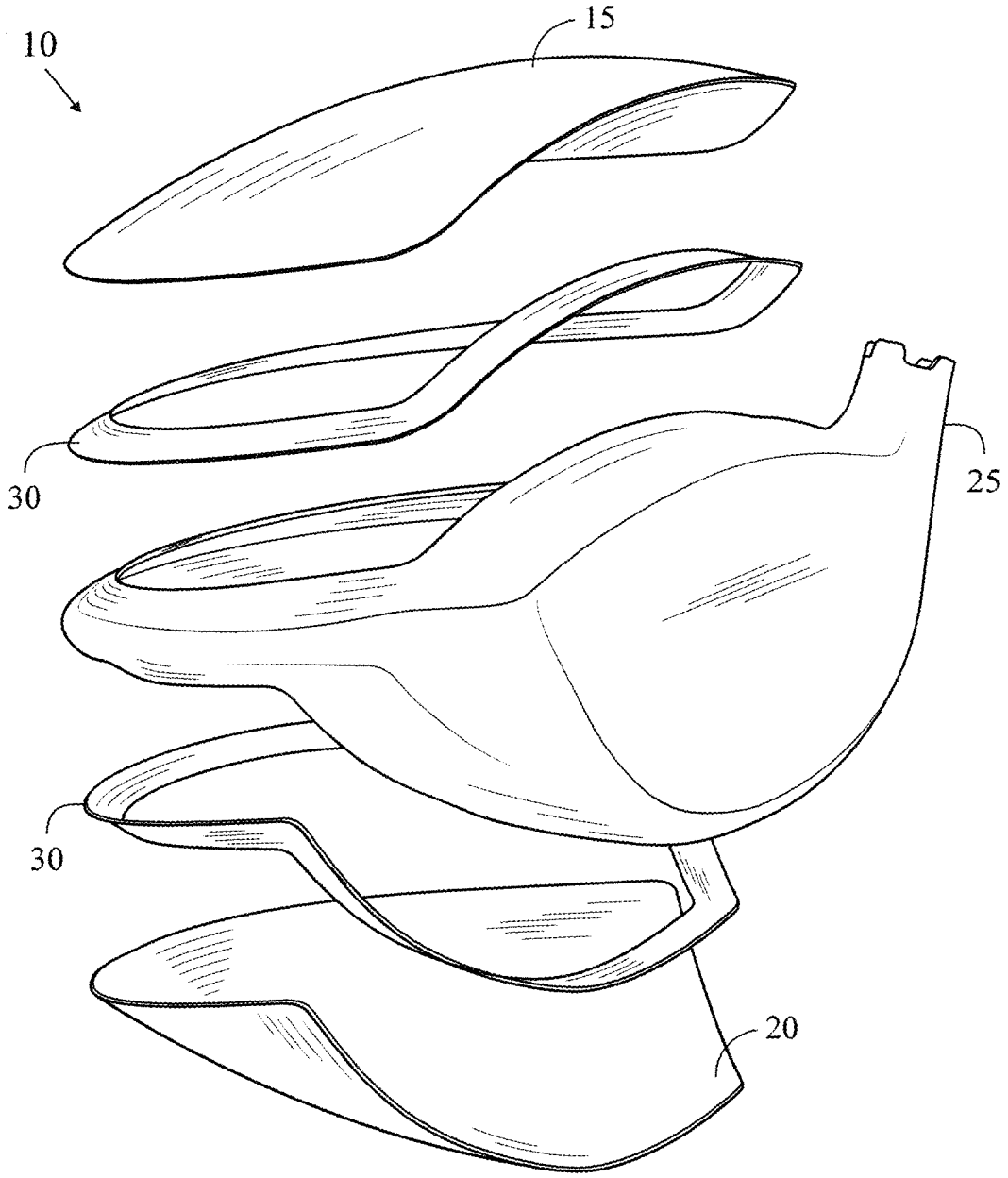
FIG. 1C is an exploded view of a golf cub head.

FIG. 1C is an exploded view of a golf club head 10 showing a composite crown 15, a composite sole 20, a body 25, and structural adhesive 30.

A composite crown 15 of a golf club head 10 is shown in FIG. 1A. The crown thickness may vary between 0.010" and 0.250". Additionally, the crown 15 can be uniform in thickness as well as varying in thickness ranging from 0.010" to 0.250" within the same component.

A composite sole 20 is shown in FIG. 1B. The sole 20 thickness may vary between 0.010" and 0.375". Additionally, the sole 20 can be uniform in thickness as well as varying in thickness ranging from 0.010" to 0.375" within the same component.

A composite face's (not shown) thickness may vary between 0.050" and 0.500". Additionally, the face can be uniform in thickness as well as varying in thickness ranging from 0.050" to 0.500" within the same component.

Stress Reducing Design/Feature Claims

The adhesive stress reducing feature of the present invention is described in the following with reference to FIGS. 5A-C, FIGS. 6A-B, and FIGS. 7A-B.

Figure 5A:
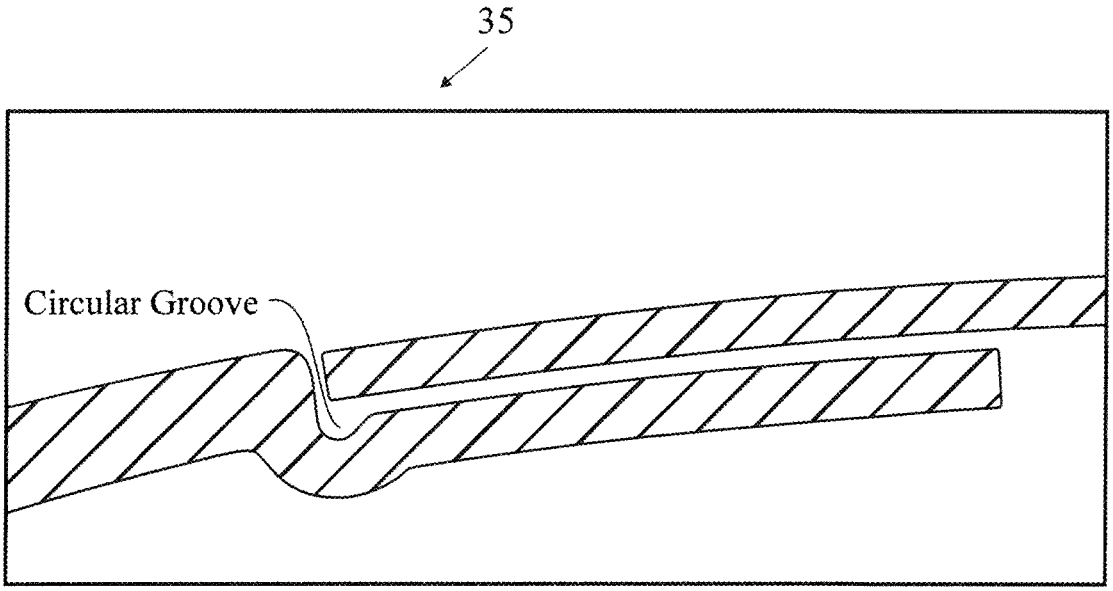
FIG. 5A is an isolated cross-sectional view of a crown-face bonding site.

In one embodiment, the stress reducing feature is cylindrical 35 in nature, as shown in FIG. 5A.

Figure 5B:
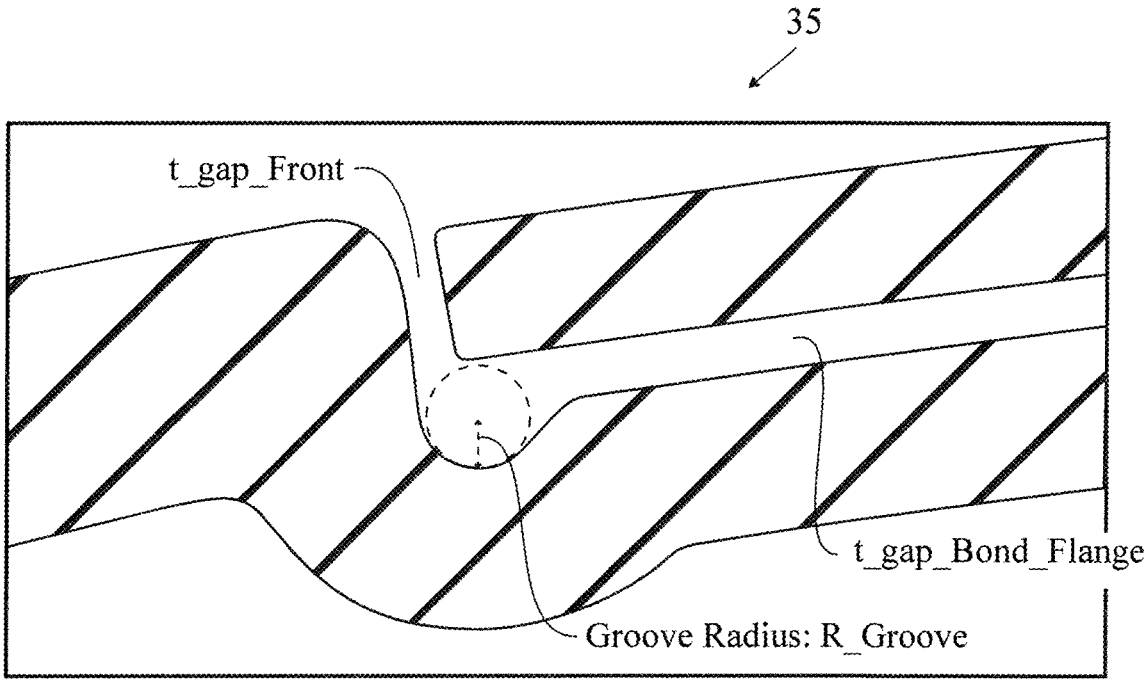
FIG. 5B is a detailed view of FIG. 5A.

With reference to FIG. 5B the following measurements for the circular groove 35 are described. The circular groove has a radius R_Groove that may vary between 0.005" and 0.050".

The adhesive thickness along the front of the joint t_gap_front may vary between 0.002" and 0.060".

The adhesive thickness along the bond flange t_gap_Bond_Flange may vary between 0.003" up to 0.125".

Figure 5C:
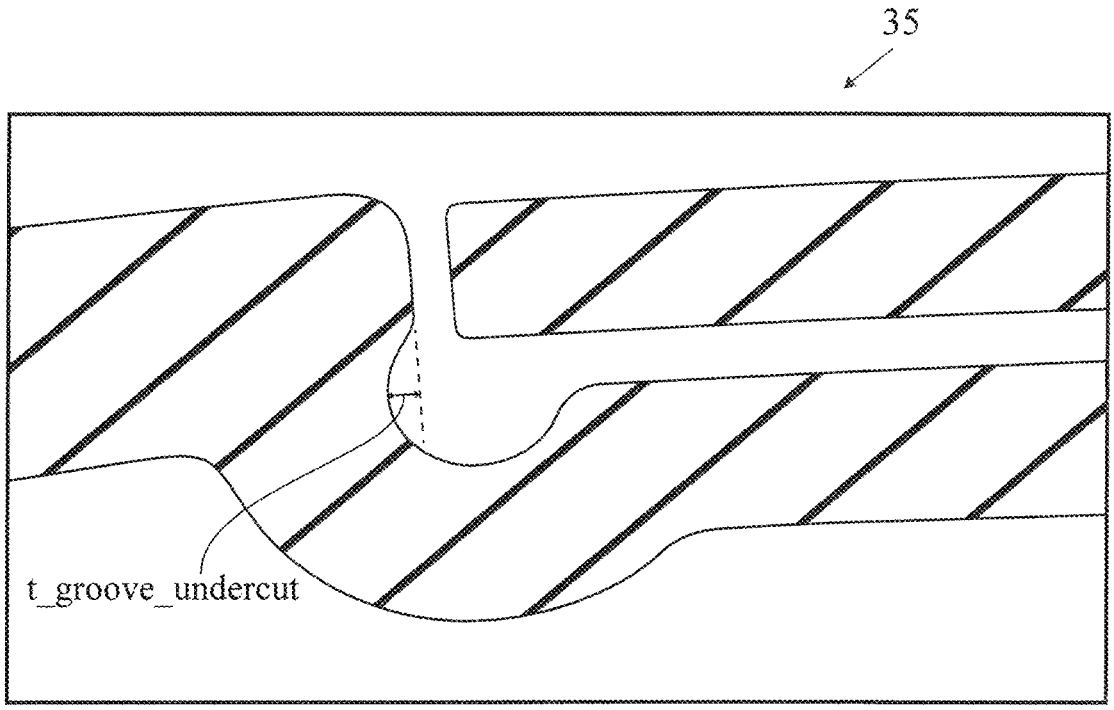
FIG. 5C is a detailed view of FIG. 5A.

The circular groove may be tangent to the front wall of the bonded joint. The circular groove may be placed so that an undercut t_groove_undercut, as shown in FIG. 5C, is present which may vary between 0.005" up to 0.060".

Figure 6A:
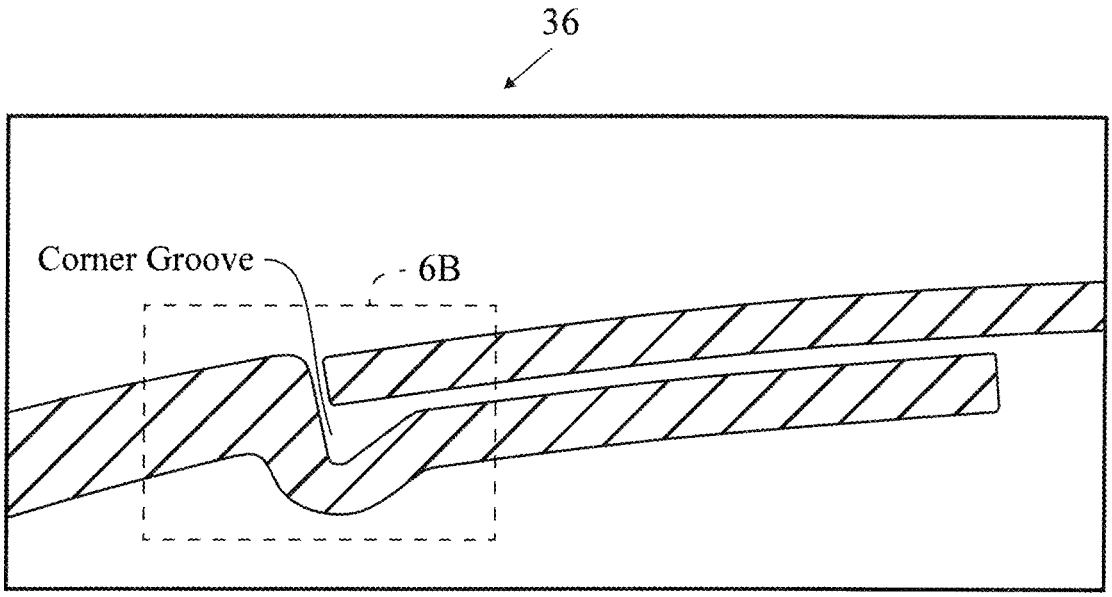
FIG. 6A is an isolated cross-sectional view of a crown-face bonding site.

In an alternative embodiment, the stress reducing feature is an intersecting corner 36 in nature as illustrated in FIG. 6A.

Figure 6B:
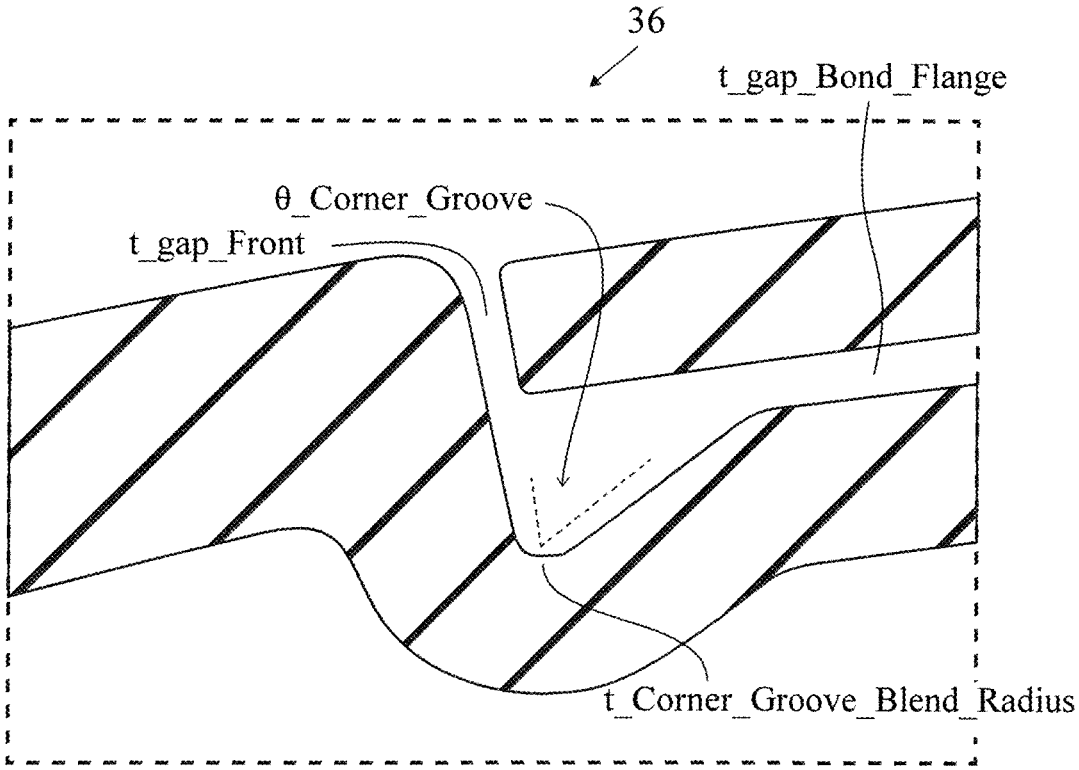
FIG. 6B is a detailed view of FIG. 6A.

With reference to FIG. 6B the following measurements for the corner groove 36 are described.

The angle at which the corner groove is formed, θ_Corner_Groove may vary between 10 degrees and 85 degrees.

The intersection of the corner groove is blended (t_Corner_Groove_Blend_Radius) and may have a radius that varies between 0.005" and 0.060".

The adhesive thickness along the front of the joint t_gap_front may vary between 0.002" and 0.060".

The adhesive thickness along the bond flange t_gap_Bond_Flange may vary between 0.003" up to 0.125".

Figure 7A:
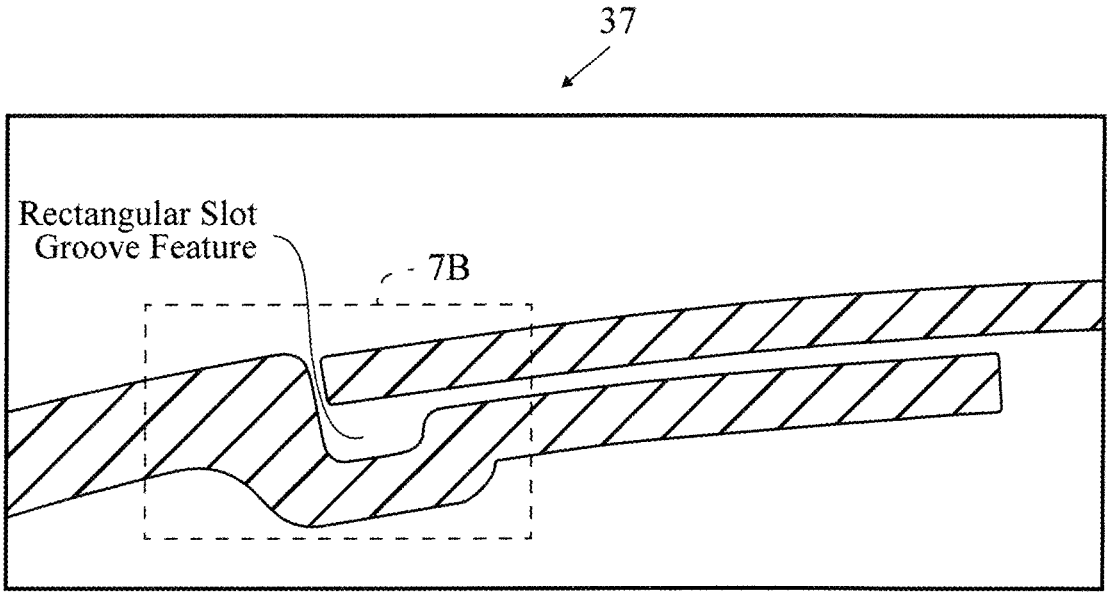
FIG. 7A is an isolated cross-sectional view of a crown-face bonding site.

In an alternative embodiment, the stress reducing feature is a rectangular slot 37 in nature, as illustrated in FIG. 7A.

Figure 7B:
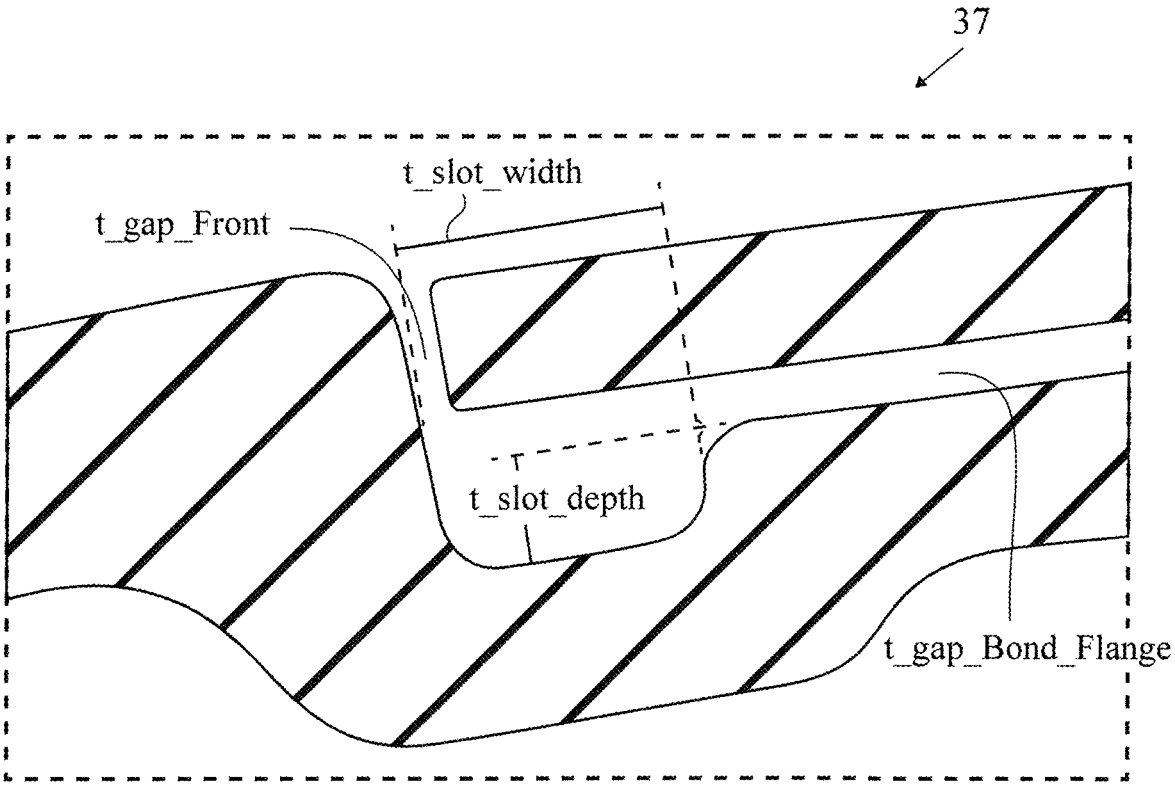
FIG. 7B is a detailed view of FIG. 7A.

With reference to FIG. 7B the following measurements for the rectangular slot groove 37 are described.

The depth of the slot, t_slot_depth may vary between 0.005" and 0.060". The width of the slot, t_slot_width may vary between 0.010" and 0.500".

The adhesive thickness along the front of the joint t_gap_front may vary between 0.002" and 0.060". The adhesive thickness along the bond flange t_gap_Bond_Flange may vary between 0.003" up to 0.125".

EXPERIMENTAL DATA

Figure 8A:
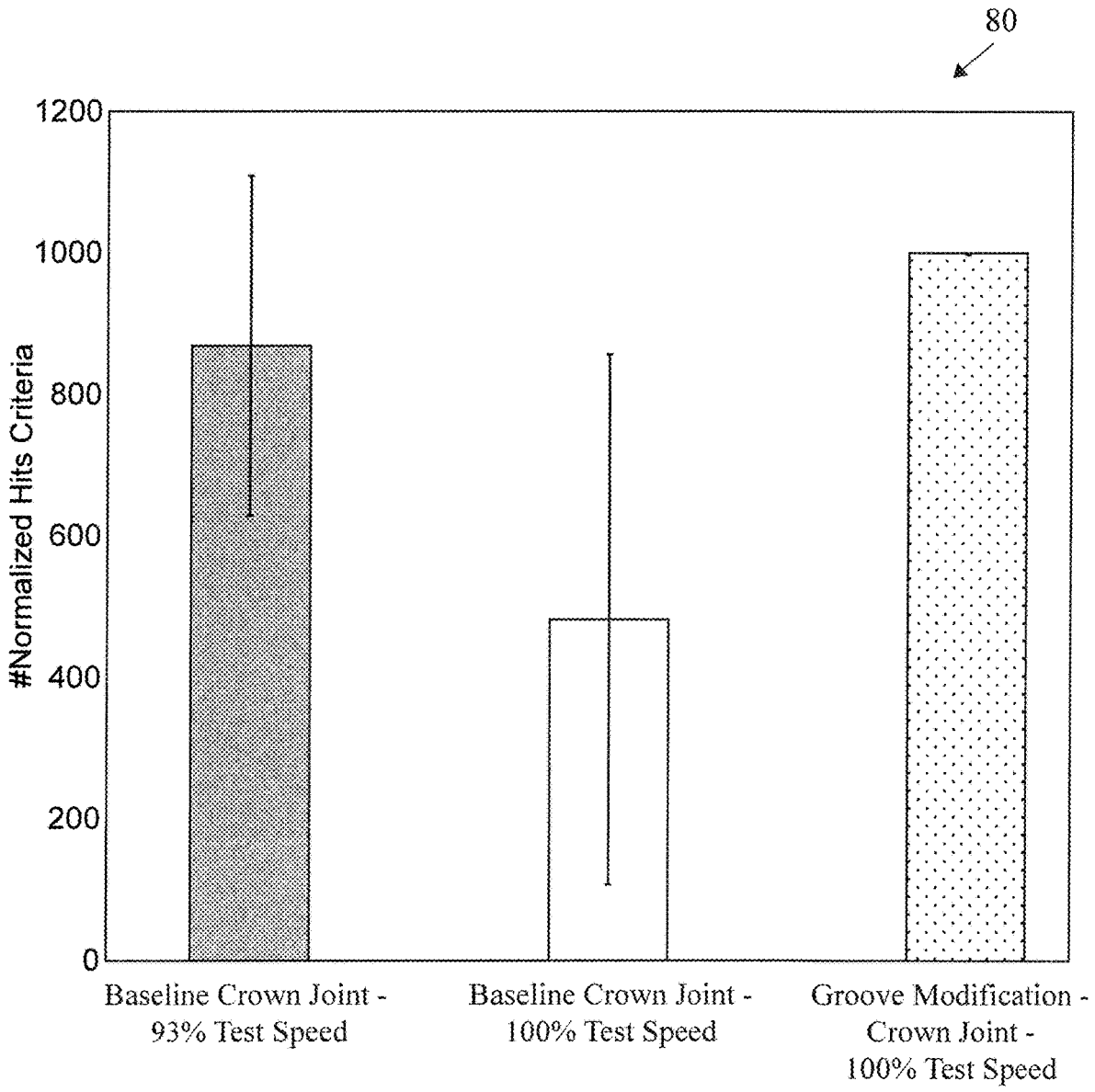
FIG. 8A is a bar graph.

As it pertains to this invention, validation of the efficacy of the adhesive stress reducing features was proven out experimentally on actual prototype heads. A summary 80 of the results is shown in FIG. 8A.

Figure 8B:
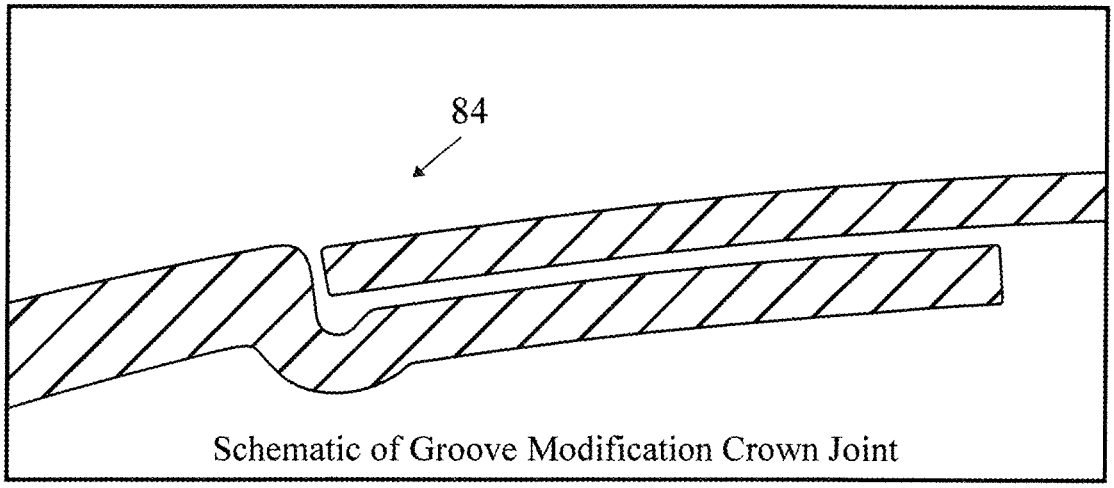
FIG. 8B is an isolated cross-sectional view of a crown-face bonding site.
Figure 8C:
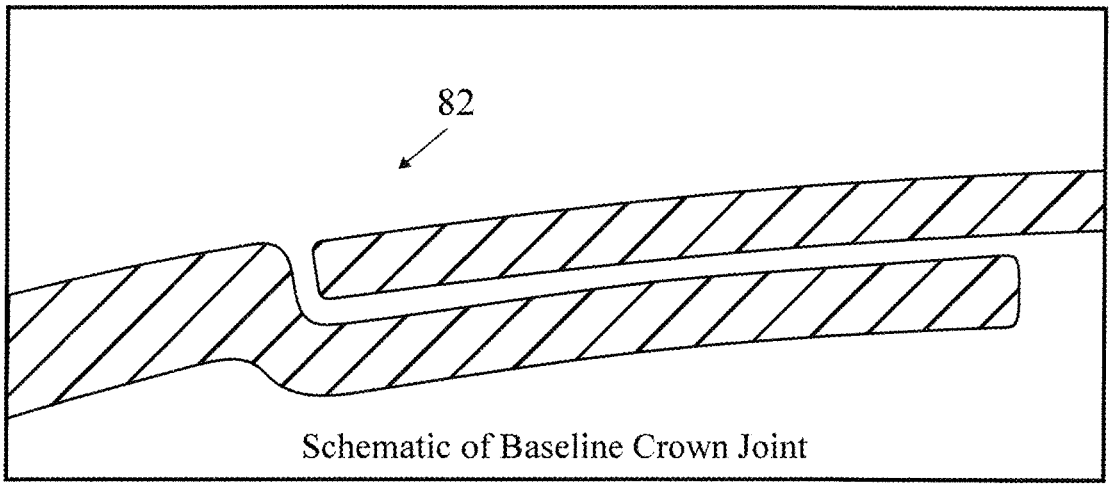
FIG. 8C is an isolated cross-sectional view of a crown-face bonding site.
Figure 8D:
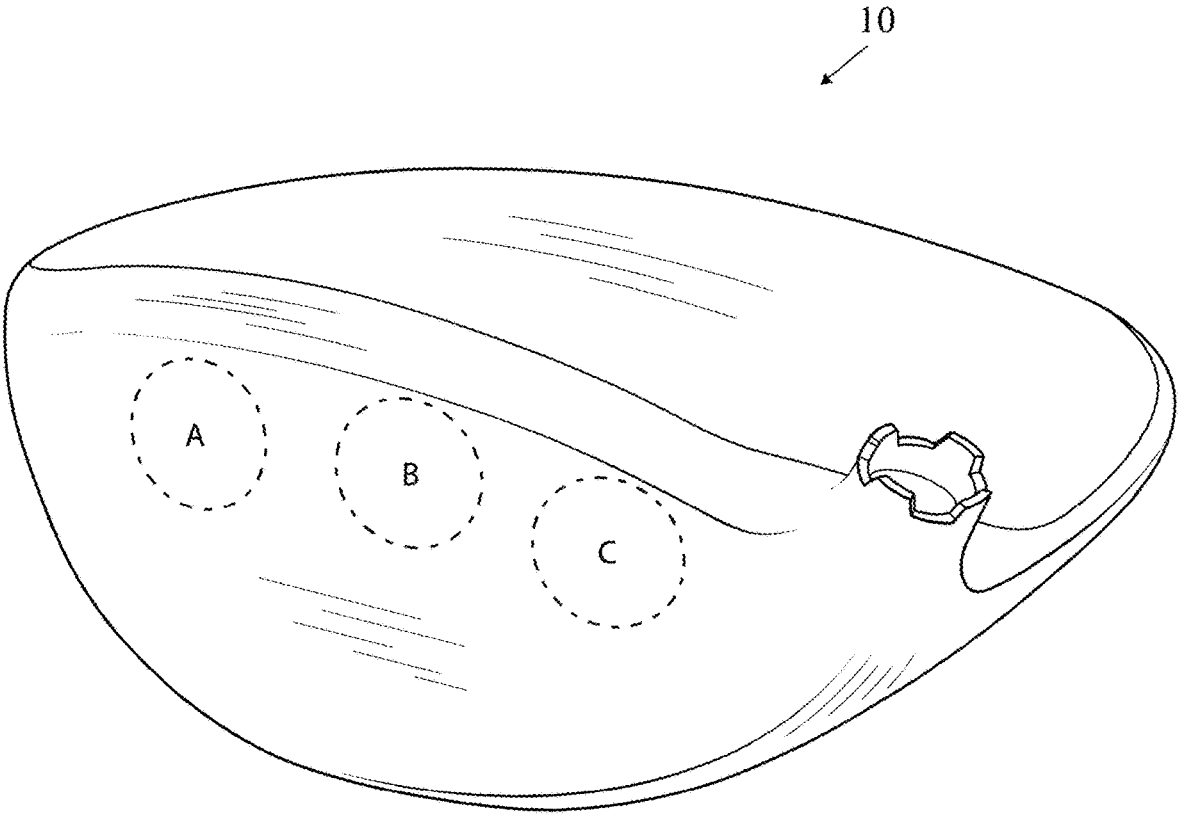
FIG. 8D is a top perspective of a golf club head showing hit impact locations.

Two head configurations were considered namely a baseline crown butt joint 82 configuration (FIG. 8C) versus the same head with the addition of a stress reducing feature 84 (FIG. 8B). The test consisted of impacting the golf heads 10 repeatedly with golf balls at three different locations, high toe A, high center B, and high heel C, as shown in FIG. 8D, each impact at consistent intervals.

In summary of the experimental data, the efficacy of the stress reducing groove as it pertains to increasing the durability of the bonded joint to repeated golf ball impacts is clearly illustrated. The groove modification joint 84 outperformed the baseline joint 82 at 100% test speed and also at 93% test speed, as shown in FIG. 8A.

The use of a groove type feature near the composite bonded joint in a golf head allows for the reduction of adhesive stress but more importantly, increases the durability of the bonded joint as it pertains to repeated golf ball impacts. By adding the types of groove features described herein, as shown in FIGS. 4A-4C, durability was improved drastically compared to a baseline design.

At 100% test speed, in reference to FIG. 8A, the entirely of the modified crown joint lasted the intended number of hits criteria with no reported failures. On the other hand, on average, the baseline head configuration only reached roughly 48% of the durability criteria. In other words, on average the baseline head configuration had crown failures at roughly 50% of the durability criteria. Additional testing was performed on the baseline heads at 93% test speed. On average, only 86% of the durability criteria was reached.

Figure 10A:
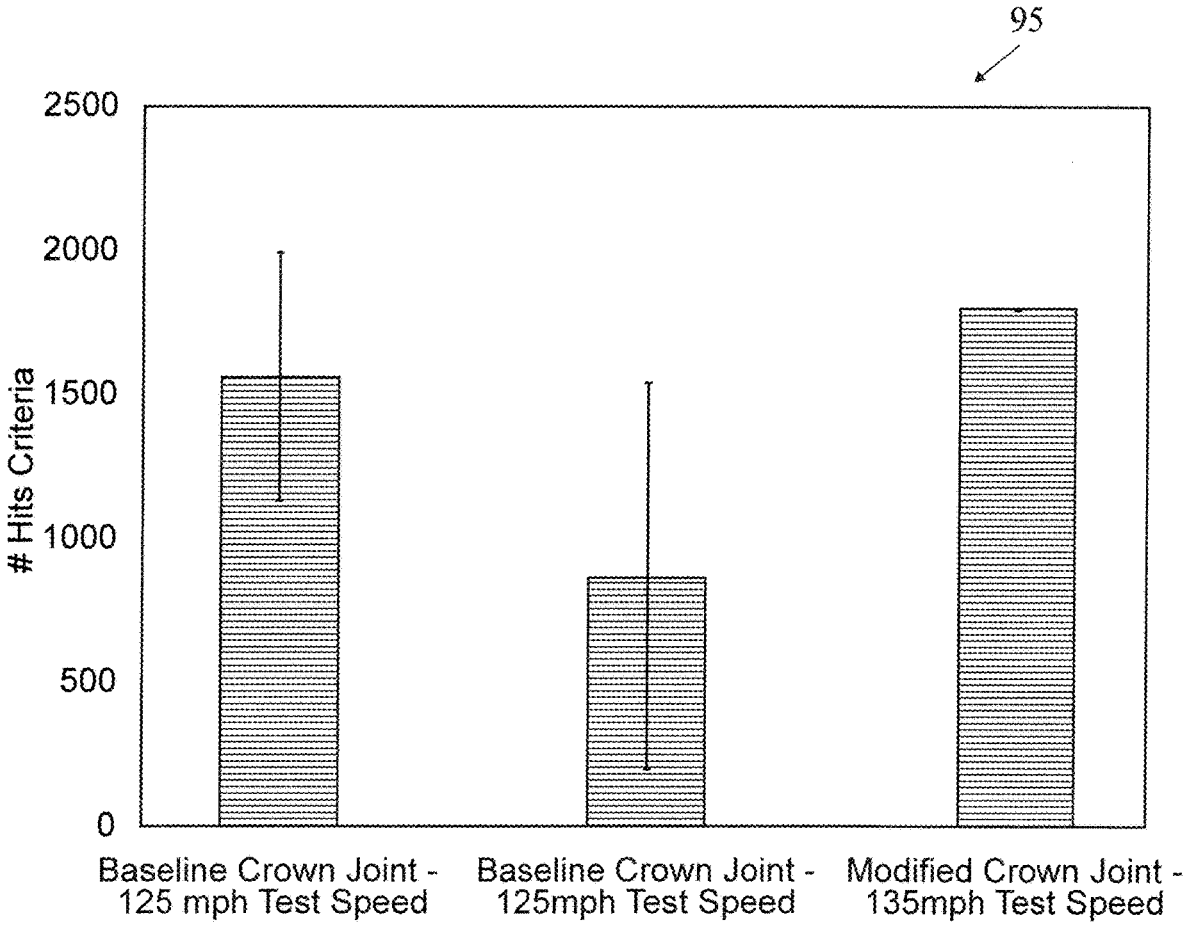
FIG. 10A is a bar graph.
Figure 10B:
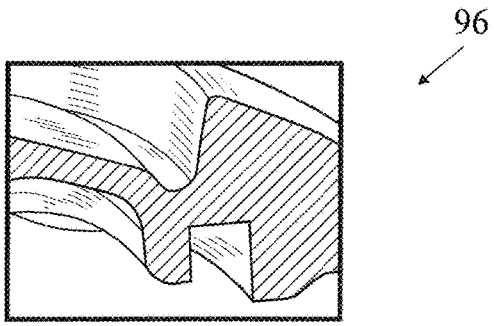
FIG. 10B is an isolated view of a modified crown joint.

FIG. 9 shows tables 90 and 92 of further testing between the baseline joint and the modified joint. A summary 95 of the results is shown in FIG. 10A. Even at a higher test speed, the modified joint outperforms the baseline joint. FIG. 10B shows a modified crown joint 96.

When the golf club head 10 is designed as a driver, it preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. In the preferred embodiment, the golf club head has a volume of approximately 450 cc to 460 cc. The volume of the golf club head will also vary between fairway woods (preferably ranging from 3-woods to eleven woods) with smaller volumes than drivers. When designed as a driver, the golf club head preferably has a mass of no more than 215 grams, and most preferably a mass of 180 to 215 grams; when designed as a fairway wood, the golf club head preferably has a mass of 135 grams to 200 grams, and preferably from 140 grams to 165 grams.

In preferred embodiments disclosed herein, the metal body is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body is composed of 17-4 steel alloy. Additional methods for manufacturing the body include forming the body from a flat sheet of metal, super-plastic forming the body from a flat sheet of metal, machining the body from a solid block of metal, electrochemical milling the body from a forged pre-form, casting the body using centrifugal casting, casting the body using levitation casting, and like manufacturing methods.

In other embodiments, the golf club head may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

Seluga et al., U.S. Pat. No. 9,757,629 for a Golf Club Head Having Stress Reducing Features is hereby incorporated by reference in its entirety.

Seluga et al., U.S. Pat. No. 9,776,058 for a Golf Club Head Having Optimized Ball Speed To CT Relationship is hereby incorporated by reference in its entirety.

Seluga et al., U.S. Pat. No. 11,433,281 for a Method For Manufacturing Golf Club Head Having Stress Reducing Features is hereby incorporated by reference in its entirety.

Gibbs et al., U.S. Pat. No. 11,433,282 for a Method For Manufacturing Golf Club Head Having Stress Reducing Features is hereby incorporated by reference in its entirety.

Davis et al., U.S. Pat. No. 11,400,349 for Golf Club Head With Heel And Toe Stiffeners is hereby incorporated by reference in its entirety.

Nunez et al., U.S. Pat. No. 11,364,423 for a Golf Club Head Having Stress Reducing Features is hereby incorporated by reference in its entirety.

DeMille et al., U.S. Pat. No. 11,331,544 for Binder Jet Printed Golf Club Components With Lattice Structures is hereby incorporated by reference in its entirety.

Westrum et al., U.S. Pat. No. 11,090,534 for a Golf Club Head Comprising Microscopic Bubble Material is hereby incorporated by reference in its entirety.

Frederickson, U.S. Pat. No. 11,083,939 for a Golf Club Head With Adjustable Sole Weight is hereby incorporated by reference in its entirety.

Del Rosario et al., U.S. Pat. No. 11,027,176 for a Golf Club Head With Hosel Support Structurel is hereby incorporated by reference in its entirety.

Hanhart et al., U.S. Pat. No. 10,912,970 for a Golf Club Head Having Adjustable Stress Reducing Features is hereby incorporated by reference in its entirety.

Frederickson, U.S. Pat. No. 10,716,984 for a Golf Club Head With Adjustable Center Of Gravity is hereby incorporated by reference in its entirety.

DeMille et al., U.S. Pat. No. 10,105,579 for a Golf Club Head With A Compression-Molded, Thin-Walled Aft-Body is hereby incorporated by reference in its entirety.

Seluga, U.S. Pat. No. 10,099,096 for a Golf Club Head With Center Of Gravity Adjustability That Optimizes Products Of Inertia is hereby incorporated by reference in its entirety.

Seluga, U.S. Pat. No. 9,968,834 for a Golf Club Head With Adjustable Center Of Gravity is hereby incorporated by reference in its entirety.

DeMille et al., U.S. Pat. No. 9,283,447 for a Golf Club Head With Composite Face is hereby incorporated by reference in its entirety.

Griffin et al., U.S. Pat. No. 9,381,409 for a Multiple Material Iron is hereby incorporated by reference in its entirety.

DeMille et al., U.S. Pat. No. 9,387,373 for a Golf Club Head With Composite Weight Port is hereby incorporated by reference in its entirety.

Rice et al., U.S. Pat. No. 9,468,819 for a Golf Club Head is hereby incorporated by reference in its entirety.

U.S. Pat. No. 10,238,933 is hereby incorporated by reference in its entirety.

U.S. Pat. No. 9,259,627 is hereby incorporated by reference in its entirety.

U.S. Pat. No. 9,180,349 is hereby incorporated by reference in its entirety.

U.S. Pat. No. 8,834,294 is hereby incorporated by reference in its entirety.

U.S. Pat. No. 9,352,199 is hereby incorporated by reference in its entirety.

U.S. Pat. No. 9,067,110 is hereby incorporated by reference in its entirety.

U.S. Pat. No. 9,345,936 is hereby incorporated by reference in its entirety.

U.S. Pat. No. 8,956,244 is hereby incorporated by reference in its entirety.

DeMille, et al, U.S. patent application Ser. No. 18/212,612, filed on Jun. 21, 2023, for a Golf Club Head, is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims.

Therefore, the embodiments of the invention in which an exclusive property or privilege is claimed are defined in the following appended claims.

We claim as our invention the following:

1. A golf club head comprising:

a body comprising face section, a composite sole section and a composite crown section, the body defining a hollow interior;

wherein the golf club head has a stress reducing feature at a composite bonded joint, wherein the stress reducing feature is cylindrical with a circular groove that is tangent to a front wall of the bonded joint and has a radius, R_Groove, that ranges between 0.005 inch and 0.050 inch, and the circular groove forms an undercut, t_groove_undercut, that ranges between 0.005 inch to 0.060 inch.

* * * * *